US006359411B1

(12) United States Patent
Kösters et al.

(10) Patent No.: US 6,359,411 B1
(45) Date of Patent: Mar. 19, 2002

(54) DISPLACEMENT MACHINE FOR COMPRESSIBLE MEDIA

(75) Inventors: Heiner Kösters, Itzehoe; Guido Keller, Hagen, both of (DE)

(73) Assignee: Sterling Fluid Systems and GmbH, Itzehoe (DE)

( * ) Notice: Subject to any disclaimer, the term of this patent is extended or adjusted under 35 U.S.C. 154(b) by 0 days.

(21) Appl. No.: 09/619,600

(22) Filed: Jul. 19, 2000

(30) Foreign Application Priority Data

Jul. 19, 1999 (EP) ..... 99114031

(51) Int. Cl.[7] ..... H02P 1/46
(52) U.S. Cl. ..... 318/700; 418/9; 418/201.1
(58) Field of Search ..... 318/41, 49, 76, 318/85, 700, 705; 418/9, 201.1

(56) References Cited

U.S. PATENT DOCUMENTS 4,792,295 A * 12/1988 Joyce, Sr. ..... 418/31
5,040,949 A * 8/1991 Crinquette et al. ..... 417/205
5,108,275 A * 4/1992 Sager ..... 418/201.3
5,197,861 A * 3/1993 Maruyama et al. ..... 417/42
5,348,448 A * 9/1994 Ikemoto et al. ..... 417/17
5,374,173 A * 12/1994 Maruyama et al. ..... 418/201.1
5,393,201 A * 2/1995 Okutani et al. ..... 417/16
5,695,316 A * 12/1997 Schutz et al. ..... 415/90
5,704,250 A * 1/1998 Black ..... 74/424.8 B
5,767,635 A * 6/1998 Steffens et al. ..... 318/85
5,836,746 A * 11/1998 Maruyama et al. ..... 417/44.1

FOREIGN PATENT DOCUMENTS

| | | |
|---|---|---|
| CH | 246525 | 10/1947 |
| DE | 197 49 572 A1 | 5/1999 |
| DE | 198 00 825 A1 | 7/1999 |
| FR | 1500160 | 1/1968 |
| GB | 165 890 A | 4/1986 |

OTHER PUBLICATIONS

European Search Report dated Dec. 1, 2000.

* cited by examiner

*Primary Examiner*—Robert E. Nappi
*Assistant Examiner*—Rina I. Duda
(74) *Attorney, Agent, or Firm*—Alix,Yale & Ristas, LLP

(57) ABSTRACT

A displacement machine for compressible media has at least two shafts with rotors which are designed as helical profile bodies. During rotation, the profiles intermesh like gears and run free of contact relative to one another. The lead of the helical profile bodies decreases from the inlet end to the outlet end and have a double-start design, with the leads at the inlet end and outlet end of the helical profile bodies being constant, and the intermediate lead decreasing continuously from the larger lead at the inlet end to the smaller lead at the outlet end.

6 Claims, 2 Drawing Sheets

DISPLACEMENT MACHINE FOR COMPRESSIBLE MEDIA

BACKGROUND OF THE INVENTION

The invention relates to a displacement machine for compressible media, in particular a dry-running vacuum pump, having at least two shafts with rotors which are designed as helical profile bodies and whose profiles intermesh like gears during the rotation and run free of contact relative to one another, the lead of the helical profile bodies decreasing from the inlet to the outlet.

In a known displacement machine of this type (DE 195 30 662 A), two intermeshing profile bodies are used. The latter enclose a certain volume at the inlet end, and this volume then moves to the outlet end during rotation of the rotors. In the process, compression takes place, since the lead decreases and thus the enclosed delivery volume becomes smaller towards the outlet end. In this way, the compressible medium is delivered from the inlet end to the outlet end and compressed in the process. The continuously changing lead certainly produces the compression but has the following disadvantages.

Since the lead decreases immediately at the inlet end, the delivery volume is smaller than would correspond to the lead directly at the inlet end. This leads to a restriction in the suction capacity. On the outlet side, on account of the decreasing lead and reduction in the delivery volume up to the end of the rotors, compression still takes place continuously, so that there are pressure differences between the instantaneously last delivery volume not yet opened and the following delivery volume, and these pressure differences, via unavoidable gaps between the rotors and the walls, give rise to a backflow of the medium into the delivery volume following from the inlet side or into the following delivery volumes, as a result of which the delivery capacity is likewise reduced. For the power input, the volume of the delivery chamber at the instant of opening at the outlet end is decisive. Since this volume, on account of the constantly decreasing lead, has not yet assumed the value which corresponds to the lead at the outlet end, a considerable loss of efficiency results.

SUMMARY OF THE INVENTION

The object of the invention is to provide a displacement machine of the type mentioned at the beginning which exhibits a more favourable pumping behaviour and in which the delivery capacity is increased.

The solution according to the invention consists in the fact that the helical profile bodies are of double-start design, and the leads at the inlet end and outlet end of the helical profile bodies are constant, and in between the lead decreases continuously from the larger lead at the inlet end to the smaller lead at the outlet end.

The lead is therefore constant at the inlet end. As a result, the original delivery volume is of the size corresponding to the lead at the inlet end. This delivery volume is not decreased by the lead decreasing immediately. The region having a constant lead at the inlet end advantageously extends over at least one turn (360°). A constant lead is also provided again at the outlet end and is smaller than the lead at the inlet end. As a result, the abovementioned problems of the backflow are very greatly reduced, since an essentially constant pressure prevails over one turn or even several turns. The final pressure of the pump is thus also reduced. At the same time, the power input is reduced on account of the smaller delivery volume.

Located between the two regions having constant leads is the section in which the lead at the inlet end is reduced to the markedly smaller lead at the outlet end. This profile is the most favourable from thermodynamic aspects.

Displacement machines are certainly known in which the rotors at the inlet end and outlet end in each case have constant leads (GB 2 227 057 B, EP 0 183 380 B1). However, these displacement machines are intended for the delivery of liquids which may contain entrapped gas. Since liquids cannot be compressed to an appreciable degree, the gap widths between the rotors and the wall of the delivery space must be dimensioned in such a way that liquid can flow during the compression through the gaps in accordance with the pressure difference back to the inlet side. So that a reasonable pumping action is nonetheless achieved, regions having a constant lead are provided at the inlet end and outlet end, and these regions deliver the liquid normally without compression, since otherwise no reasonable pumping action could be achieved on account of the requisite large gap widths referred to. Since these pumps are not of the generic type and the problems with the delivery of liquid are completely different than in the case of compressible media, the displacement machines according to the invention cannot be inferred at all from these pumps.

In addition, as far as can be seen, the rotors of the previously known displacement machines are single start. In the displacement machine according to the invention, the helical rotors are double-start in order to be able to be balanced more effectively, which is absolutely necessary for high rotational speeds. In addition, the heat dissipation is increased due to the better distributed gap flows. This heat dissipation is not problematic in the liquid-delivering displacement machines of the prior art.

The leads at the inlet end and outlet end are advantageously constant over at least one turn. For compressing gases or for achieving a good vacuum, it is especially advantageous if the lead at the outlet end is constant over at least two turns. This results not only in better sealing and less backflow but also in better dissipation of the heat of compression. In a dry-running vacuum pump, the heat of compression due to the reduction in volume and the heat of compression due to the ingress of external air at the outlet end no longer occur at the same point and can therefore be dissipated more effectively.

The number of turns over which the lead is constant depends on the desired operating conditions of the pump.

An especially favourable behaviour of the displacement machine, in particular within the vacuum range, is obtained if provision is made for the shafts to each be driven by separate electric motors, the angular positions of the shafts being determined with resolvers, on the basis of the signals of which the motors are electronically synchronized, and the shafts having gears which intermesh and whose angular clearance is less than that of the profile bodies. The rotors are therefore not driven via gear units but are driven in a completely non-contact manner by separate electric motors, the purpose of the gears merely being to prevent the sensitive surfaces of the rotors from coming into contact and being damaged in the event of failure of the electronic synchronization. Instead, the gears will come into contact first, which causes no problems, in particular if they are provided with an appropriate surface.

If a differential control for the speed of the motors is provided, the pumpability and the reliability of the pump will be further increased. For example, if liquid penetrates into the pump, both rotors are uniformly affected; the difference will change only slightly. On the other hand, if the control were to be carried out at a preset value independently for both rotors, very large speed changes would have to be effected at both rotors if the rotors are suddenly braked by penetrating liquid.

Three-phase motors having a permanently magnetic rotor as drive have proved to be especially expedient for operation.

BRIEF DESCRIPTION OF THE DRAWINGS

The invention is described below with reference to an advantageous embodiment and the attached drawings, in which.

DETAILED DESCRIPTION OF THE PREFERRED EMBODIMENTS

Figure 1:
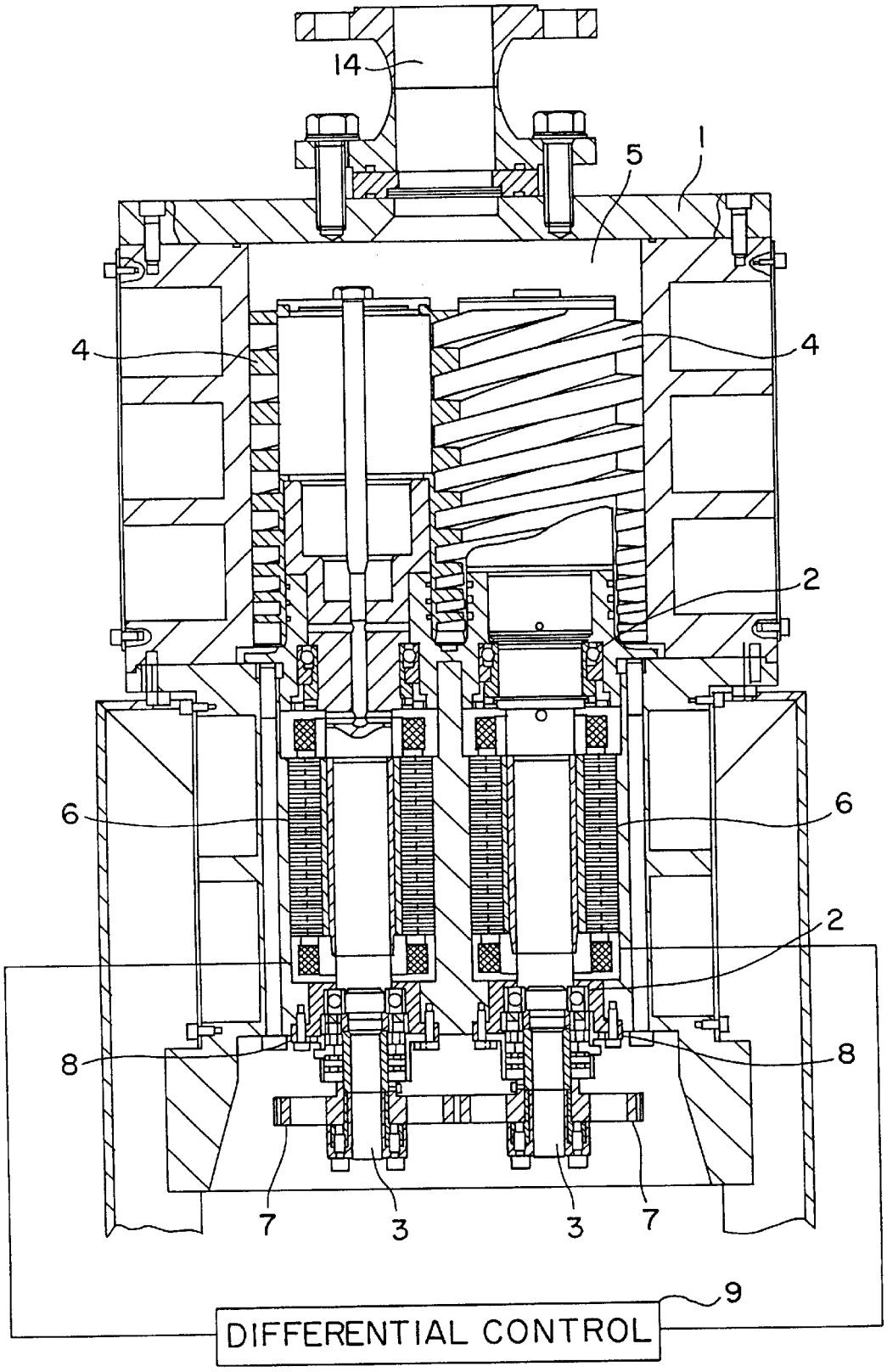
FIG. 1 is a schematic view of a displacement machine in accordance with the invention.

As shown in FIG. 1, two shafts 3, to which intermeshing profile bodies 4 are fastened, are mounted with bearings 2 in a pump casing 1 composed of a plurality of parts, the profile bodies 4 drawing in the medium to be delivered in the pump space 5 from the top through a connection 14 and discharging it at the bottom through openings (not shown). The shafts 3 and the profile bodies 4 are driven by electric motors 6, a separate electric motor 6 being provided for each shaft 3. Two intermeshing gears 7 are provided at the bottom on the shafts 3. The motors 6 are electronically synchronized by means of resolvers 8. In adverse operating conditions, if the electronic synchronization is insufficient, the gears 7 come into contact first, since they have a smaller angular clearance than the rotors 4. Normally, however, the gears 7 are not in contact, so that lubrication of these gears may be dispensed with.

Figure 2:
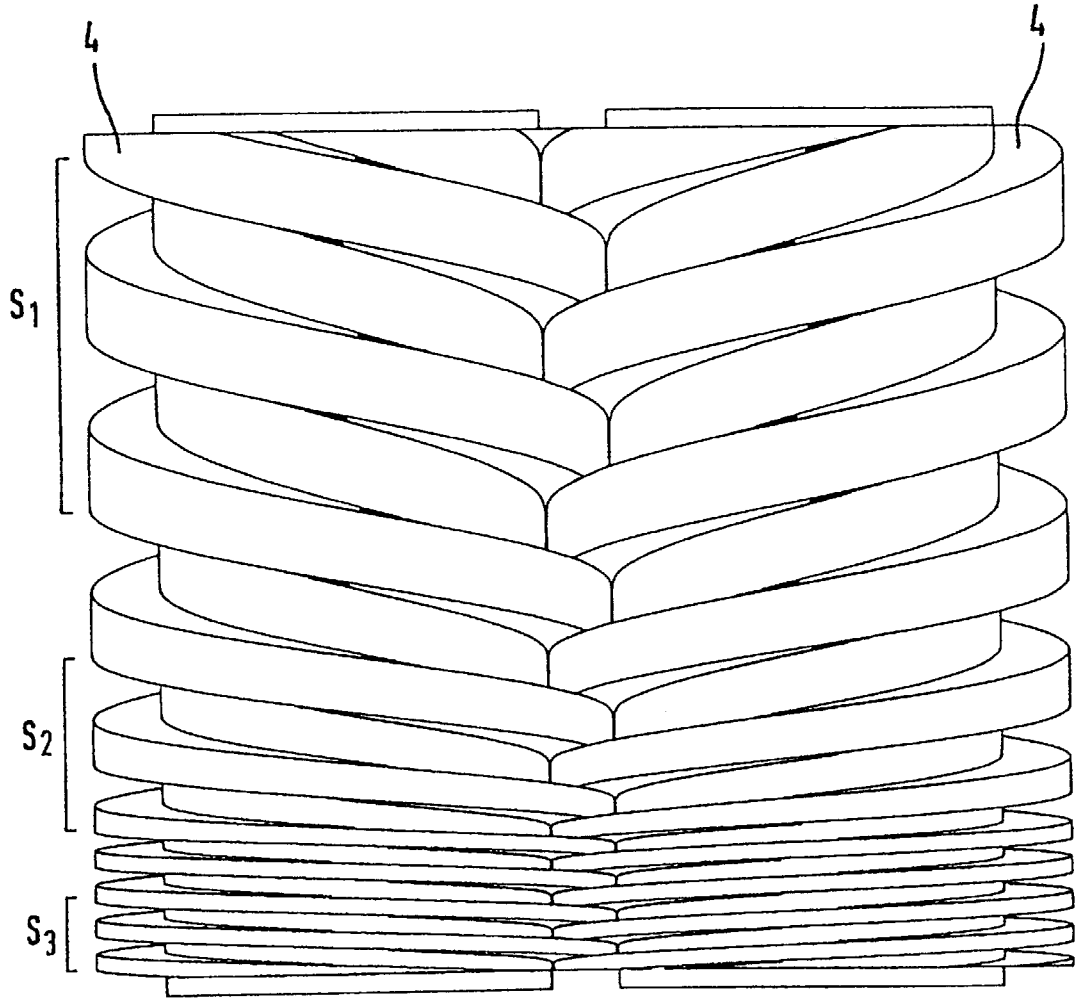
FIG. 2 is an enlarged schematic view of the profile bodies of FIG. 1.

Rotors according to the invention, in which the lead decreases from top (inlet end) to bottom (outlet end), are shown in FIG. 2. In the inlet region, the lead $S_1$ has a constant value over at least one turn. The same applies to the lead $S_3$ at the outlet end, which is also constant there but substantially smaller than the lead $S_1$ at the inlet end. In this case, the region of constant lead $S_3$ advantageously extends over at least two turns of the rotors 4. Between inlet end with lead $S_1$ and outlet end with lead $S_3$, the lead $S_2$ changes continuously from the value $S_1$ to the value $S_3$.

The pumpability and reliability of the displacement machine is improved when a differential control 9 for the speed of the motors 6 is provided. For example, if liquid penetrates into the pump, both rotors are uniformly affected, the difference will change only slightly. On the other hand, if the control were to be carried out at a preset value independently for both rotors, very large speed changes would have to be effected at both rotors if the rotors are suddenly braked by penetrating liquid.

What is claimed is:

1. Displacement machine for compressible media comprising:

at least two shafts and a rotor mounted to each shaft, each of the rotors having oppositely disposed inlet and outlet ends and defining a helical profile body, the profiles of the helical profile bodies intermeshing like gears during rotation and running free of contact relative to one another, each of the helical profile bodies having a double-start design with a lead which decreases from the inlet end to the outlet end, wherein the lead at the inlet end and the lead at the outlet end of the helical profile bodies are constant, with the lead at the inlet end being greater than the lead at the outlet end, and the lead intermediate the inlet and outlet ends decreases continuously from the lead at the inlet end to the lead at the outlet end.

2. Displacement machine according to claim 1, further comprising at least one resolver, a gear mounted on each shaft and a separate electric motor coupled to each shaft, the angular positions of the shafts being determined with the resolvers, on the basis of the signals of which the motors are electronically synchronized, and the gears which intermesh and whose angular clearance is less than that of the profile bodies.

3. Displacement machine according to claim 2, further comprising a differential control for the speed of the motors.

4. Displacement machine according to claim 2, wherein the motors are three-phase motors having a permanently magnetic rotor.

5. Displacement machine for compressible media comprising:

at least two shafts and a rotor mounted to each shaft, each of the rotors having oppositely disposed inlet and outlet ends and defining a helical profile body, the profiles of the helical profile bodies intermeshing like gears during rotation and running free of contact relative to one another, each of the helical profile bodies having a double-start design with a lead which decreases from the inlet end to the outlet end, wherein the lead at the inlet end and the lead at the outlet end of the helical profile bodies are constant, with the lead at the inlet end being greater than the lead at the outlet end, and the lead intermediate the inlet and outlet ends decreases continuously from the lead at the inlet end to the lead at the outlet end;

wherein the leads at the inlet end and outlet end are constant over at least one turn.

6. Displacement machine according to claim 5, wherein the lead at the outlet end is constant over at least two turns.

* * * * *

UNITED STATES PATENT AND TRADEMARK OFFICE

CERTIFICATE OF CORRECTION

PATENT NO. : 6,359,411 B1 
DATED : March 19, 2002
INVENTOR(S) : Kosters et al.

It is certified that error appears in the above-identified patent and that said Letters Patent is hereby corrected as shown below:

Title page,
Item [73], Assignee, delete "Sterling Fluid Systems and GmbH," and insert
-- Sterling Fluid Systems (Germany) GmbH, --

Signed and Sealed this

Tenth Day of September, 2002

*Attest:*

*Attesting Officer*

JAMES E. ROGAN
*Director of the United States Patent and Trademark Office*